US005306182A

United States Patent [19]

Fukushima et al.

[11] Patent Number: 5,306,182

[45] Date of Patent: Apr. 26, 1994

[54] ELECTRIC CONNECTOR TERMINAL

[75] Inventors: Minoru Fukushima, Yokohama; Shinichi Aihara, Atsugi, both of Japan

[73] Assignee: Molex Incorporated, Lisle, Ill.

[21] Appl. No.: 23,291

[22] Filed: Feb. 26, 1993

[30] Foreign Application Priority Data

Mar. 2, 1992 [JP] Japan ..... 4-80508

[51] Int. Cl.[5] ..... H01R 13/11

[52] U.S. Cl. ..... 439/857

[58] Field of Search ..... 439/842, 856, 857, 397–401

[56] References Cited

U.S. PATENT DOCUMENTS

| | | | |
|---|---|---|---|
| 2,767,283 | 10/1956 | Jung | 200/133 |
| 3,973,919 | 8/1976 | Simon | 439/857 |
| 4,118,103 | 10/1978 | Leidy et al. | 439/398 |
| 4,408,824 | 10/1983 | Weidler | 439/857 |
| 4,900,271 | 2/1990 | Colleran et al. | 439/856 |
| 4,907,990 | 3/1990 | Bertho et al. | 439/856 |
| 4,943,248 | 7/1990 | Colleran et al. | 439/850 |
| 5,046,972 | 9/1991 | Pass | 439/856 |

FOREIGN PATENT DOCUMENTS

| | | | |
|---|---|---|---|
| 4017815 | 12/1991 | Fed. Rep. of Germany | 439/399 |
| 377284 | 8/1989 | Japan . | |

*Primary Examiner*—Gary F. Paumen

*Attorney, Agent, or Firm*—Stephen Z. Weiss

[57] ABSTRACT

An electric connector female terminal assures steady contact between a male terminal irrespective of the position and angle of insertion of the male terminal. The female terminal comprises a pair of contact beams defining a path completely through the female terminal for accommodating a male terminal. A connecting piece is integrally formed with the contact beams and extending therebetween, the connecting piece being positioned out of the path for accommodating the male terminal and incorporating resilient means for resiliently biasing the contact beams carrying the contact points to a predetermined initial position.

1 Claim, 10 Drawing Sheets

ELECTRIC CONNECTOR TERMINAL

FIELD OF THE INVENTION

The present invention relates generally to a female terminal for an electric connector. More specifically, the invention relates to an improvement for a U-shaped connector terminal, in which a pair of contact beams are formed in the base portion and contact points on each contact beam are arranged in opposition to each other.

DESCRIPTION OF THE PRIOR ART

As is well know, U-shaped electric connector terminals have been widely used in various fields. Such a connector terminal typically has a base portion, a pair of contact beams integrally formed with the base portion and extending therefrom, and is formed into generally U-shaped configuration. Normally, contact points which make electrical connection with a male terminal are formed at the free ends of the pair of contact beams so as to receive the male terminal completely through the female terminal, such as a pin type terminal. The contact points exert a predetermined magnitude of a uniform contact pressure for establishing electrical connection. Although the contact beams of this type of electric connector terminal are formed integrally with the base portion, their actions are independent of each other. In other words, since the contact beams are not mechanically connected to each other, they can act independently of each other. One typical example of this type of the electric connector terminal has been disclosed in Japanese Unexamined Patent Publication (Kokai) No. 3-77284.

In the prior art of the type briefly discussed above, when the male terminal, such as pin type terminal is inserted in proper alignment spaced equally from each contact point, which is along the center line between the pair of contact beams, then each of the contact points exerts an appropriate contact pressure to establish good electrical connection.

However, it is possible that the male terminal may be inserted slightly offset from the center line between the contact beams or at an angle. In such case, since the conventional U-shaped terminal has a pair of independently movable contact beams, the male terminal may contact only one contact point. This can cause degradation or failure of the electrical connection. Furthermore, it can cause permanent deformation of one of the contact beams to cause a failure of the electrical connection in the subsequent use.

To solve the problem of improperly inserted male terminals, prior art terminals have both ends of the contact beams fixed to one another. Example of these are shown in U.S. Pat. No. 2,767,283 filed Jul. 5, 1955 and U.S. Pat. No, 4,943,248 filed Jul. 24, 1990. However, no prior art terminals had contact beams connected to each other by a resilient connecting piece and no such terminals were adapted to receive a male terminal which can pass completely therethrough without the connecting piece obstructing the passage.

SUMMARY OF THE INVENTION

In order to overcome the above-noted defects inherent in the prior art, an object of the present invention is to provide a female terminal for an electric connector, which can assure steady contact with a male terminal irrespective of the position and angle of insertion of the male terminal and prevent the contact beams from being permanently deformed due to an offset insertion position or offset insertion angle of the male terminal while allowing the male terminal to pass completely therethrough.

The subject electric connector terminal comprises a pair of contact beams with one end extending from a base defining a path completely through the female terminal for accommodating a male terminal, to which an electrical connection is to be established.

A pair of contact points on each contact beam facing each other is adapted to make an electrical connection with the male terminal.

A resilient connecting piece is integrally formed with the ends of each contact beam opposite the terminal base. The resilient connecting piece is positioned out of the insertion path of the male terminal so that it may pass completely through the female terminal.

With the above-mentioned invention, even when the male terminal is inserted at a position offset from the center position either straight in or at an angle, both of the opposed contact points will contact the male terminal. The contact point first making contact with the male terminal will move the one contact beam. Movement of this beam will move the resilient connecting piece thereby also moving the other contact beam. Also, since the connecting piece is positioned out of the path of the male contact, insertion and removal of the male terminal will never be obstructed by the female terminal.

DESCRIPTION OF THE PREFERRED EMBODIMENT

Figure 1:
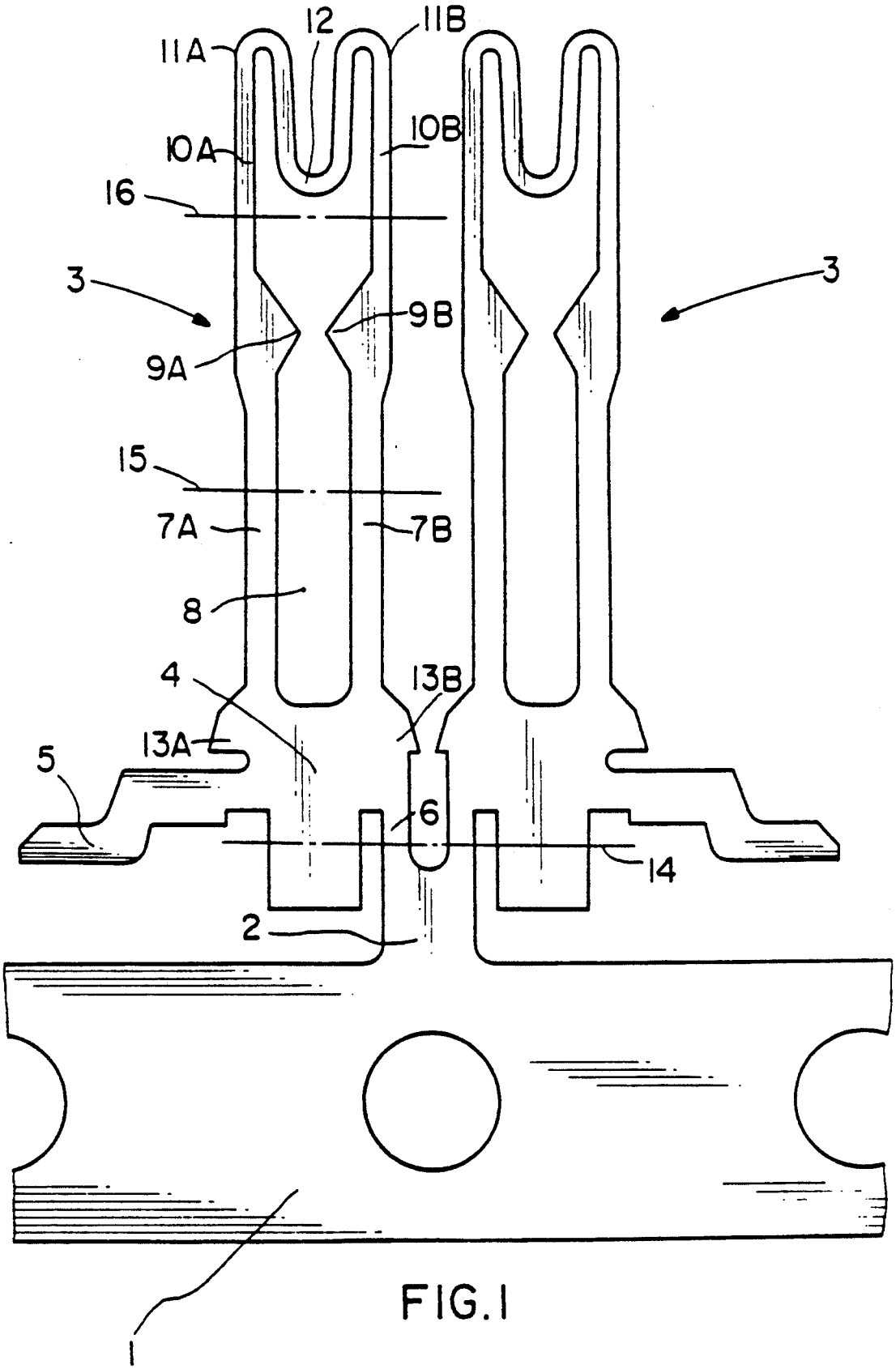
FIG. 1 is plan view of a sheet blank punched into the desired configuration for fabricating the preferred embodiment of a U-shaped female terminal according to the present invention.
Figure 2:
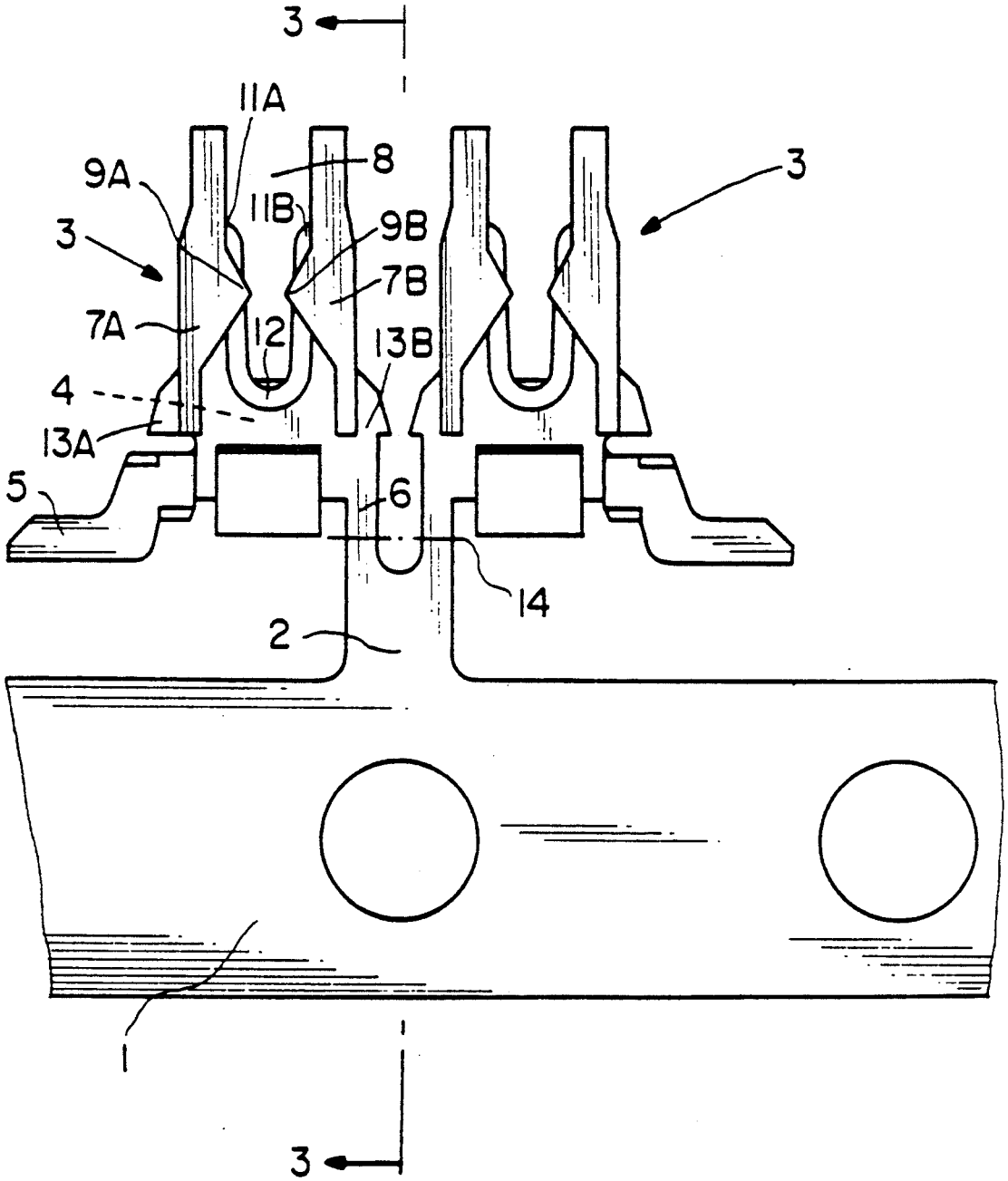
FIG. 2 is a plan view of the U-shaped terminal after the bending process performed for the sheet blank of FIG. 1.

Referring now to the drawings, particularly to FIGS. 1 to 6, construction of the preferred embodiment of an electric connector terminal 3 according to the present invention will be discussed. FIG. 1 is a sheet blank which has been punched into a predetermined configuration adapted to fabricate the electrical connector terminal 3. In the shown embodiment, the sheet blank is punched into a configuration adapted to be fabricated into a pair of terminals. However, it is not essential to fabricate the terminals in a pair. Any number can be punched including an individual terminal. The terminals 3 are punched in a form connected to a carrier strip 1 via a connecting plate 2. The terminal 3 has a base section 4. A soldering tail 5 extends laterally from the side edge of the base section. A leg 6 extends toward the connecting plate 2 and is adjoined thereto. A pair of contact beams 7A and 7B are formed integrally with the base portion 4 and extend therefrom. The contact beams 7A and 7B are positioned in a spaced parallel relationship to each other and define a gap 8 therebetween. Contact points 9A and 9B are formed on the respective edges of the contact beams 7A and 7B. The contact points 9A and 9B are symmetrically formed about the center line of the terminal 3 which extends through the lateral center of the gap 8 in parallel relationship with the longitudinal axis of the contact beams 7A and 7B. The contact points 9A and 9B are positioned in opposition to each other.

Terminal 3 further has a pair of first connecting pieces 10A and 10B extending substantially in alignment with the contact beams 7A and 7B from the ends of the latter. A second connecting piece 12 extends from the ends 11A and 11B of the first connecting pieces 10A and 10B. The second connecting piece 12 is formed in an essentially U-shaped configuration. The U-shaped configuration of the connecting piece 12 is intended to provide enough extra length for permitting the contact points 9A and 9B to shift away from each other while causing resilient deformation of the contact beams 7A and 7B for accommodating a male terminal 27 therebetween, and to provide sufficient resilient return force for restoring the initial positions of the contact points 9A and 9B and the contact beams 7A and 7B.

The rounded bottom of the U-shaped connecting piece 12 serves as a return spring which is stressed by the movement of the contact points 9A and 9B in directions to shift away from each other with accumulating resilient return force. This may be advantageous not only for providing resilient return force for the contact points 9A and 9B carried on the contact beams 7A and 7B but also for assuring firm contact between the contact points 9A and 9B and the male terminal 27 inserted therebetween. Once the force shifting the contact points 9A and 9B is released, the contact piece 12 accumulating the resilient return force becomes active to return the contact points 9A and 9B carried on the contact beams 7A and 7B to their initial positions.

It should be noted that the configuration of the contact piece 12 is not specified to the U-shaped configuration but can be of any appropriate configuration to provide extra length for accommodating expansion of the distance between the contacts 9A and 9B and for providing sufficient resilient force for returning the contacts 9A and 9B together with the contact beams 7A and 7B to the initial position.

The terminal 3 is further formed with engaging pieces 13A and 13B extending laterally from the base portion. The engaging pieces 13A and 13B are designed for engaging the housing 17 of the electric connector upon assembling the terminal 3 to the housing to complete the electric connector assembly.

Figure 3:
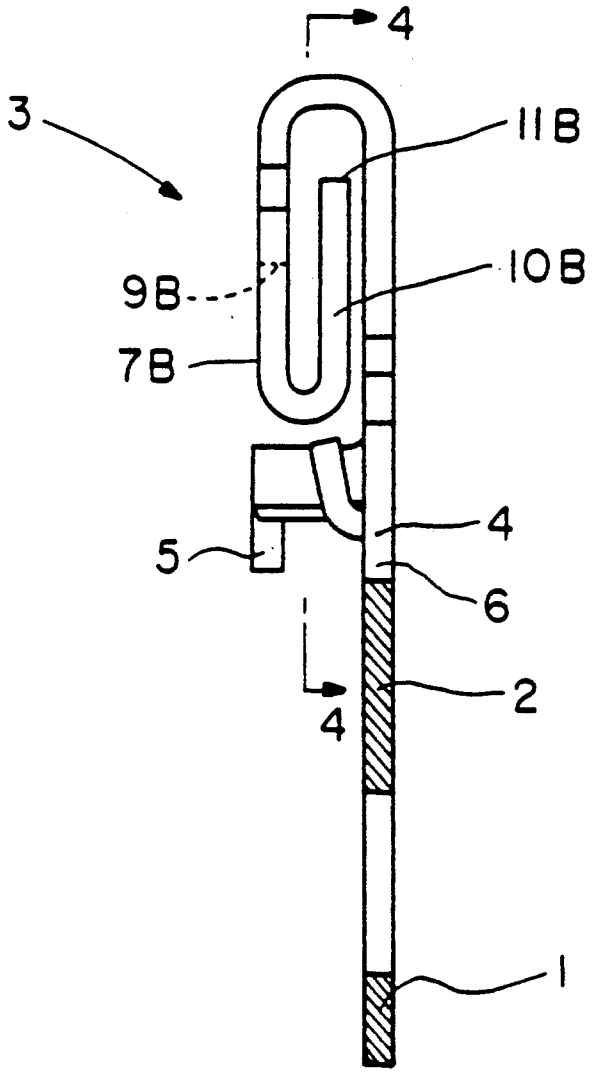
FIG. 3 is a section taken along line 3—3 of FIG. 2.

In FIG. 1, line 14, extending along the interface between the legs 6 and the connecting plate 2, is a cutting line for cutting respective terminals 3 away from the carrier strip 1. In the preferred process of fabrication of the electric connector terminal, the bending process is performed before cutting the terminals 3 away from the carrier strip 1. In the bending process, the contact beams 7A and 7B are bent at a first bending line represented by a line 15 to form a round and substantially U-shaped bend as best seen in FIG. 3. Bending is effected for the contact beams 7A and 7B to turn the portion above the bending line 15 in FIG. 1 in a direction out of the plane of the paper for forming a continuously curved bend without forming an angled edge. Further bending is effected at a second bending line 16 shown in FIG. 1 in a manner best shown in FIG. 3. The order of bending at the respective first and second bending lines 15 and 16 is not specified to the order set out above. Rather, it may be convenient to effect bending at the second bending line 16 in advance of effecting bending at the first bending line 15.

FIGS. 2 to 6 show the electric connector terminal 3 after the bending process. As set out above, after the bending process is complete, the terminal 3 is cut away from the carrier strip 1 at the cutting line 14.

Figure 4:
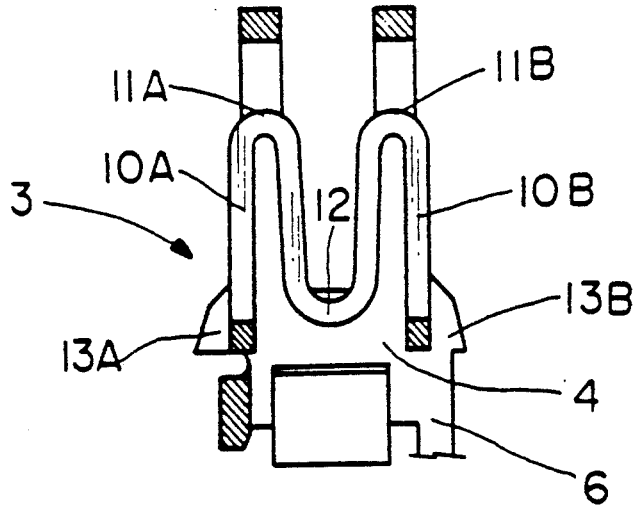
FIG. 4 is a section taken along line 4—4 of FIG. 3.
Figure 5:
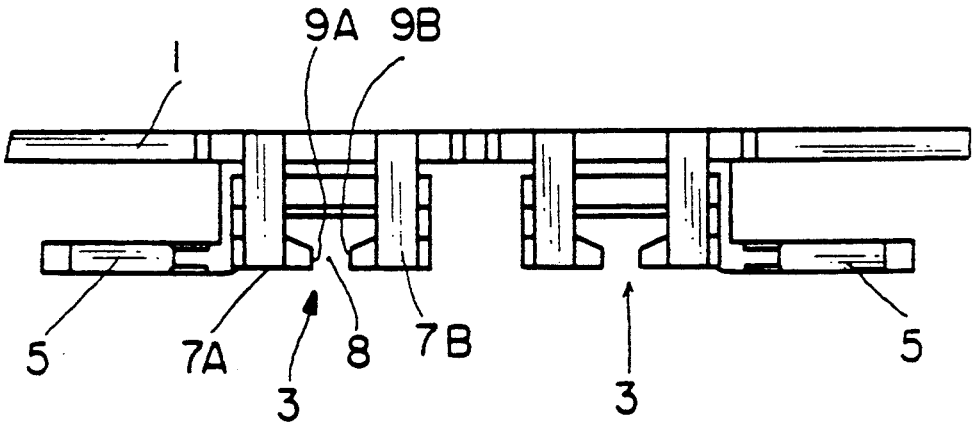
FIG. 5 is a front elevation of the terminal of FIG. 2.
Figure 6:
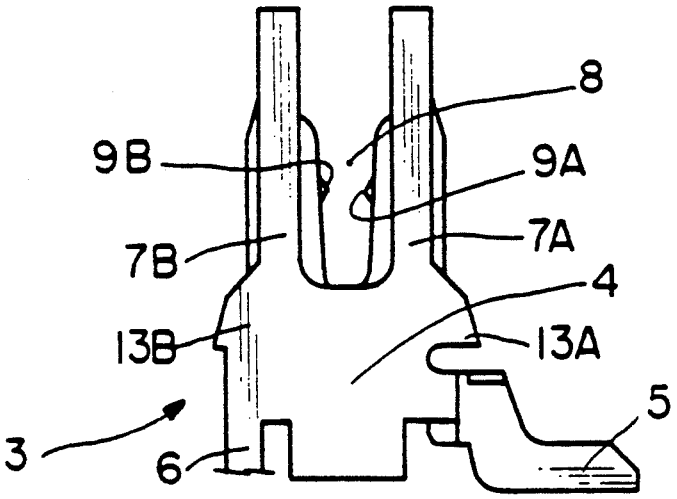
FIG. 6 is an enlarged partial back elevation of the terminal of FIG. 2.
Figure 7:
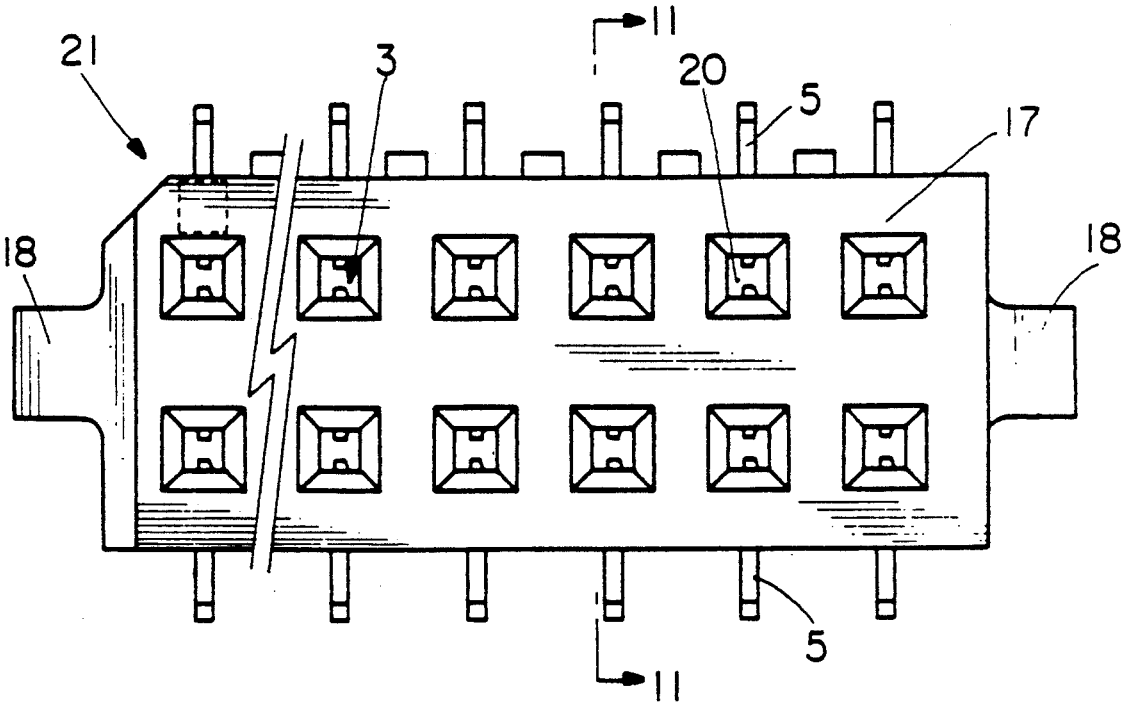
FIG. 7 is a plan view of an electric connector employing the preferred embodiment of the U-shaped terminal.
Figure 8:
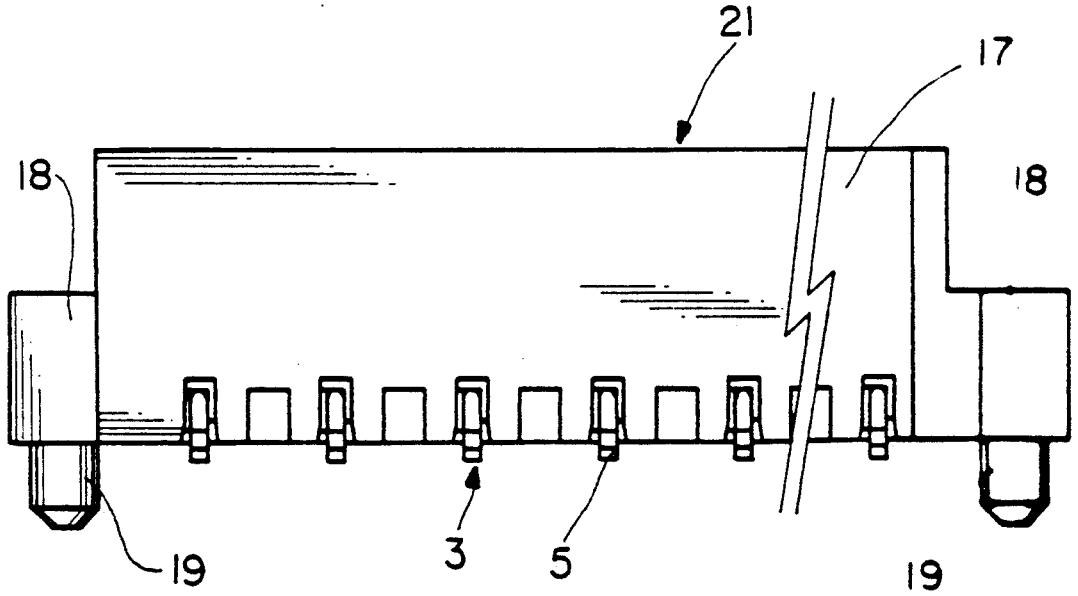
FIG. 8 is a front elevation of the electric connector of FIG. 7.
Figure 9:
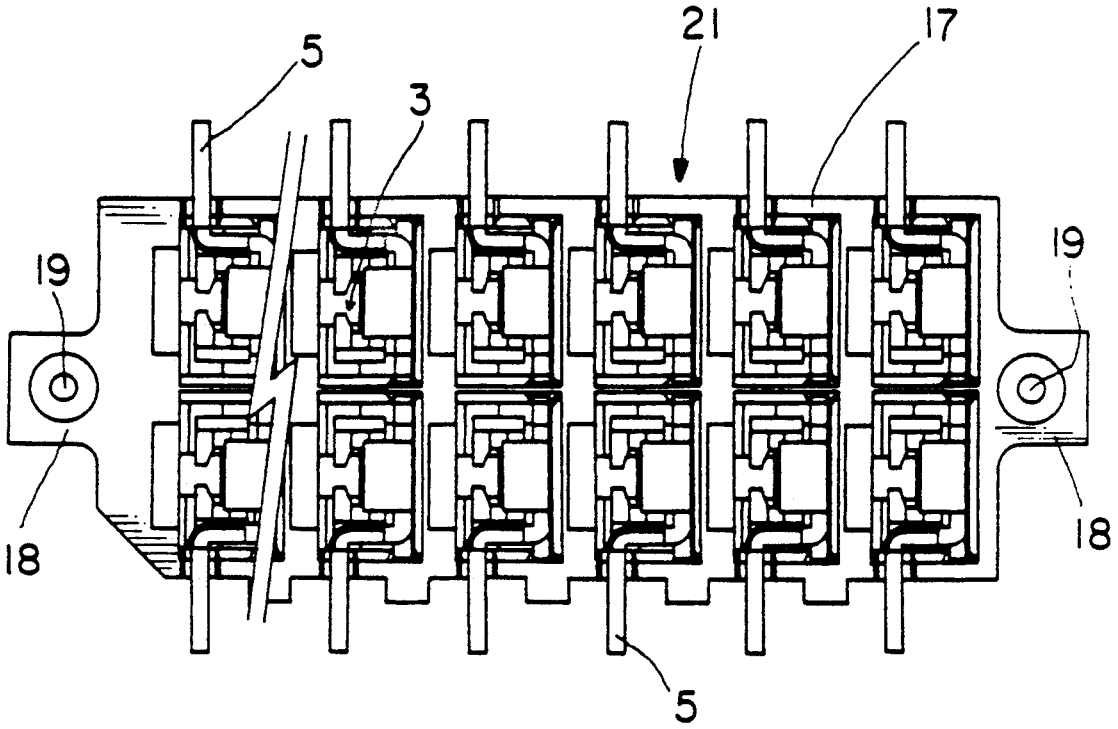
FIG. 9 is a back elevation of the electric connector of FIG. 7.
Figure 10:
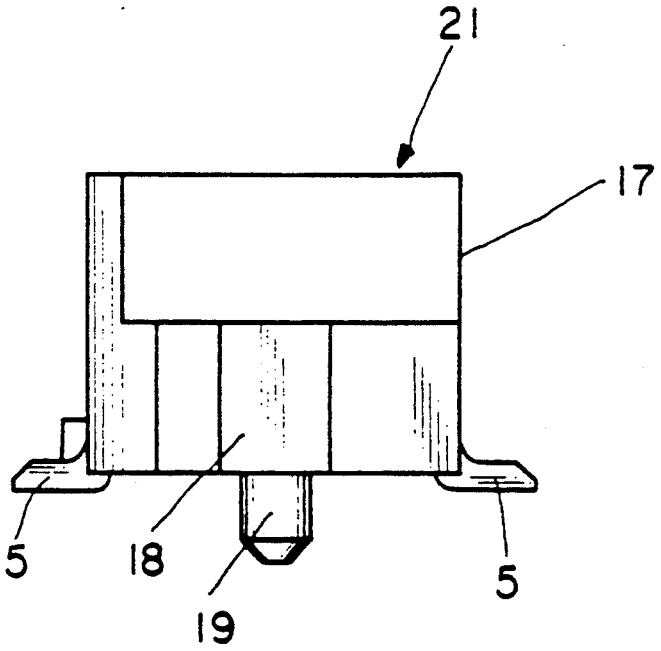
FIG. 10 is a left side elevation of the electric connector of FIG. 7.

As can be seen from FIG. 4 which is the section taken along line 4—4 of FIG. 3, the substantially U-shaped second connecting piece 12 is positioned behind the contact beams 7A and 7B offset from the insertion path of the male pin type terminal 27. Therefore, connecting piece 12 may not interfere with the insertion and removable of the male terminal 27. Furthermore, with the shown construction, the height of the contact beams 7A and 7B with the contact points 9A and 9B can be maintained equivalent to that of the conventional terminals having no connecting piece. Therefore, the size of the terminal 3 can be maintained compact enough so as not to require extra space for providing the connection piece 12.

FIGS. 7 to 12 show one example of an electric connector 21 employing the preferred embodiment of the electric connector terminal 3. The electric connector 21 includes an electrically insulative housing 17, boss sections 18 extending from both longitudinal ends of the housing 17 for receiving fixing legs 91 which extend downwardly from the lower surface of the housing 17 to engage positioning holes formed on a stationary member to mount the electric connector 21.

Figure 11:
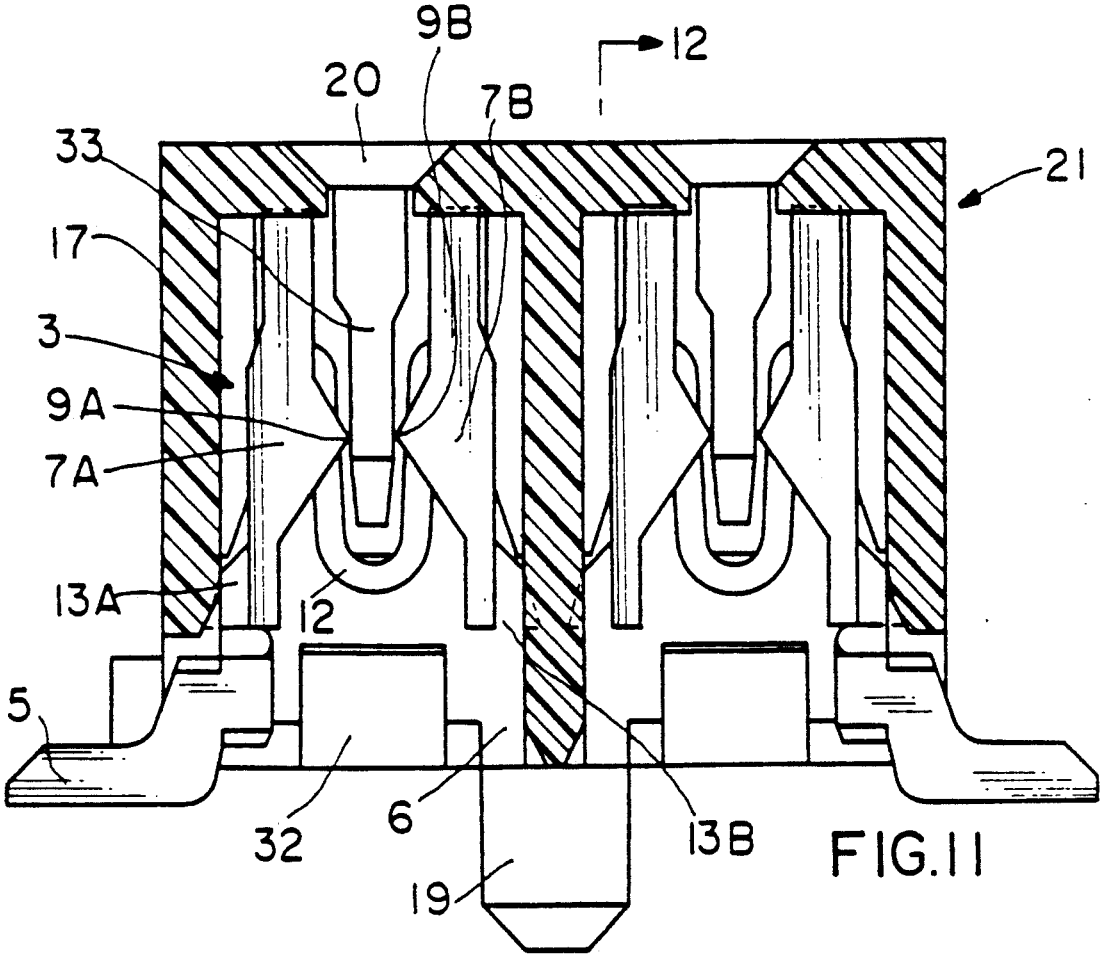
FIG. 11 is a section taken along line 11—11 of FIG. 7.

The housing 17 defines one or more terminal receptacle cavities 33 for receiving therein the electric connector terminals 3. As best shown in FIG. 11 the terminals 3 are disposed within each of the terminal receiving cavities 33 arranged in two rows respectively having a plurality of cavities in the longitudinal direction in parallel relationship to the longitudinal axis of the housing 17. Once a terminal is fully inserted within the terminal receiving cavities 33, the terminal 3 engages the engaging pieces 13A and 13B to respective peripheral walls of the terminal receptacle cavity for securing the terminal therein. In the shown inserted position, the soldering tail 5 extends from the terminal 3 beyond the transverse edge of the housing 17 so as to facilitate coupling with a trace on a printed circuit board.

The preferred embodiment of the electric connector terminal is designed for surface installation to a printed circuit board. However, the shown embodiment of the electric connector terminal 3 is applicable to electric connectors having a variety of mounting means. Therefore, the shown embodiment of the electric connector is to be understood merely as an illustrative example of the preferred embodiment of the electric connector terminal 3.

Figure 12:
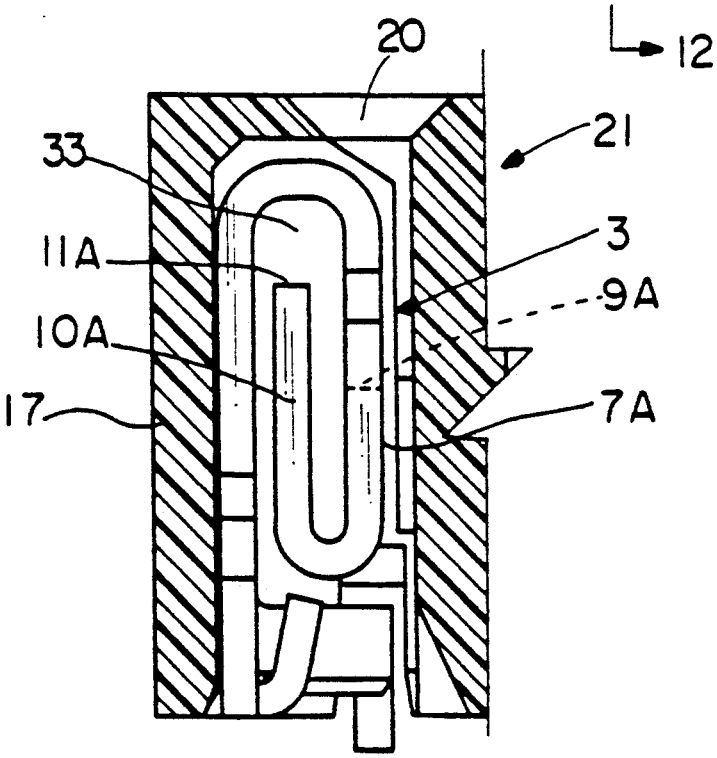
FIG. 12 is a section taken along line 12—12 of FIG. 11.

As can be seen from FIG. 11, the terminal 3, disposed in the terminal receiving cavity 33, aligns the contact points 9A and 9B with a terminal receiving opening 20 defined through the top wall of the housing 17. As shown in FIG. 12, the position of the terminal receiving opening 20 is laterally offset from the longitudinal axis position so that it may be aligned with the center axis of the gap 8 defined between the contact points 9A and 9B. At this position, the terminal 3 defines a clearance 32 below the contact points 9A and 9B to permit the male terminal 27 to extend completely therethrough.

Figure 13:
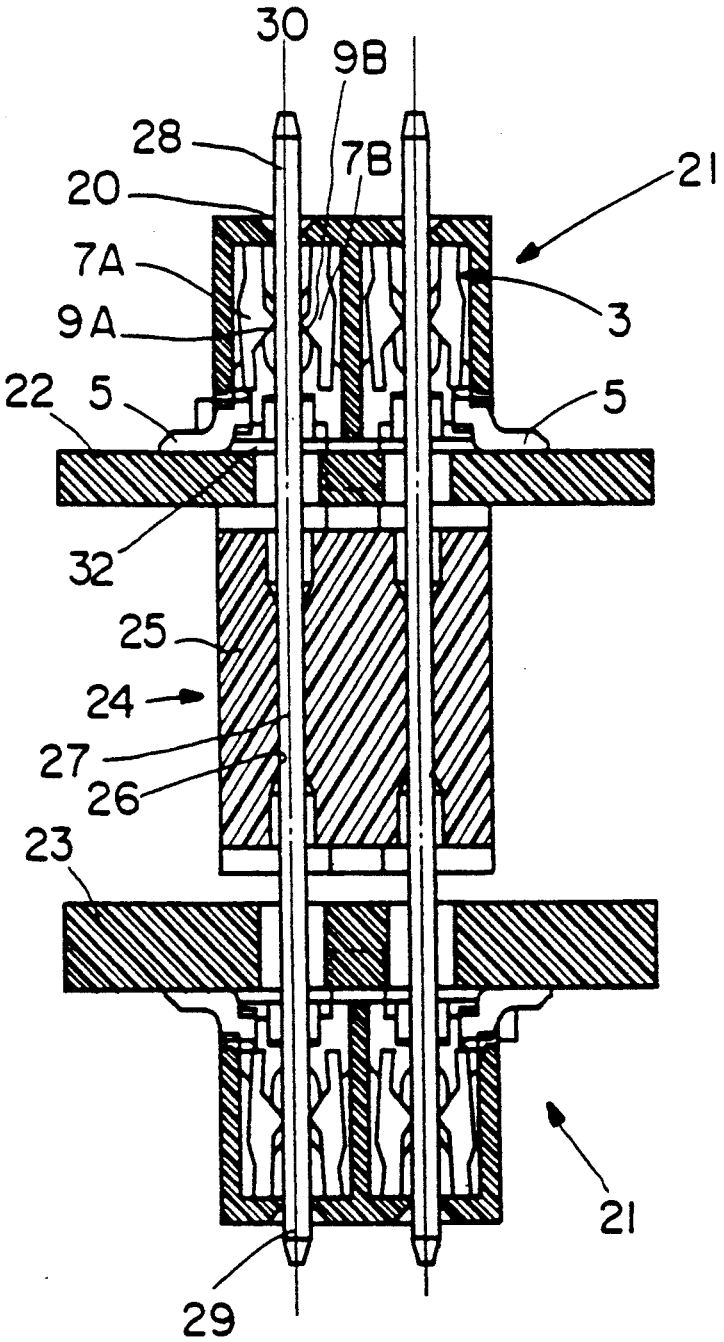
FIG. 13 is a section showing one example of engagement between the preferred embodiment of the U-shaped female terminal and a pin type male terminal.
Figure 14:
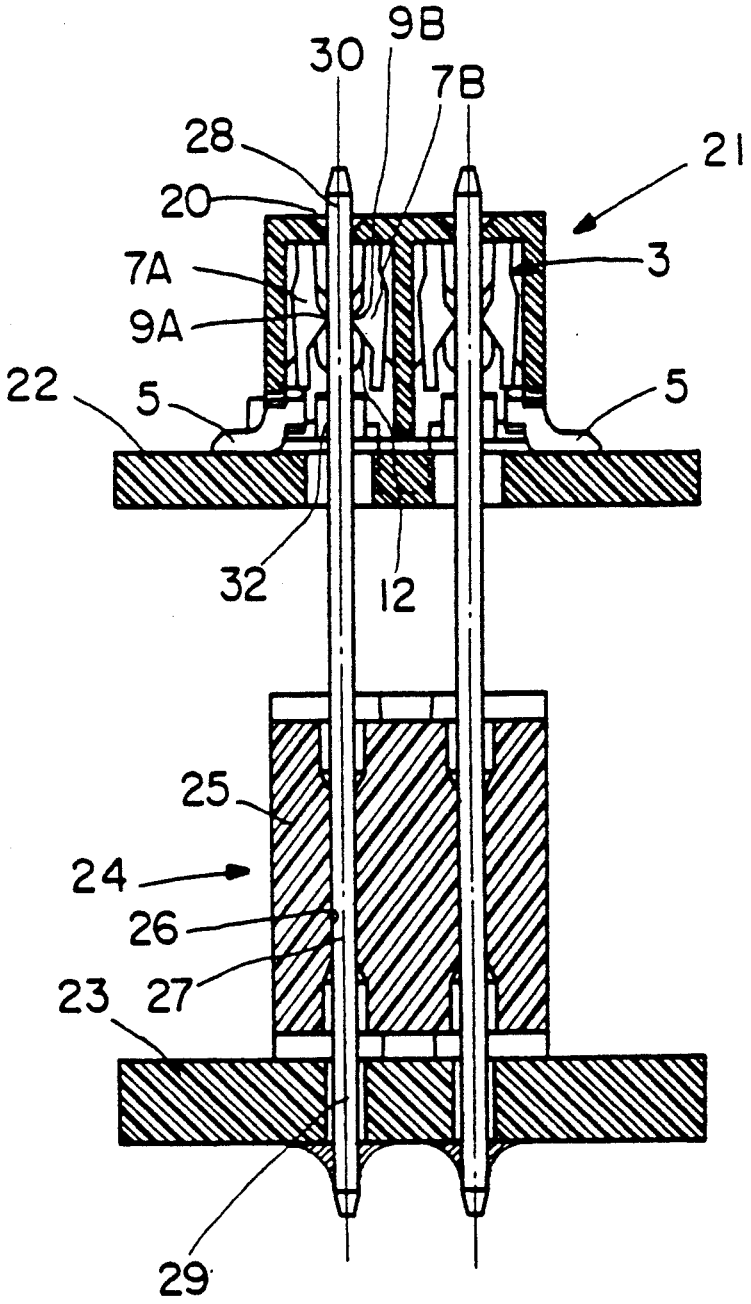
FIG. 14 is a section showing another example of engagement between the preferred embodiment of the U-shaped terminal and the pin type terminal.

Examples of how a male connector 24 with male pin terminals 27 are used to connect two printed circuit boards, are illustrated in FIGS. 13 and 14. In the shown examples, the male connectors 24 have housings 25 defining two rows of a plurality of pin holding holes 26, to which the male pin terminals 27 are inserted and extended therefrom. In the construction shown in FIGS. 13 and 14, each of the pin type terminals 27 has one extension 28 extending from one end of the housing 25 and the other extension 29 extending from the other end of the housing. One or both of the extensions 28 and 29 of the pin type terminal 27 are inserted through the terminal receiving openings 20 of the electric connector housing 17 to engage with the contact points 9A and 9B as shown in FIGS. 13 and 14.

As set forth above, the preferred embodiment of the electric connector 21 is designed for surface installation. Therefore, in the example of FIG. 13, two electric connectors 21 are installed on respective surfaces of printed circuit boards 22 and 23 as the substrates for installation. In the example of FIG. 13, both of the extensions 28 and 29 are inserted into the electric connector 3 respectively mounted on the printed circuit boards 22 and 23, though openings in the printed circuit boards 22 and 23, for establishing electrical connection between the printed circuit boards 22 and 23 therethrough. In the example of FIG. 14, the extensions 29 of the male connectors 24 are inserted into through openings defined in the printed circuit board 23 and directly secured thereto by soldering. In this case, the extension 29 is coupled with the circuit trace on the printed circuit board with direct contact or through the conductive soldering, and the electric connector 24 is fixedly secured on the printed circuit board 23. The extensions 28 of the electric connector 24 in FIG. 14 are inserted through the electric connector terminals 3 of the electric connector 21 mounted on the printed circuit board 22 for establishing electrical connection between the printed circuit boards 22 and 23.

In the examples shown in both FIGS. 13 and 14, the extensions 28 and 29 of the pin type terminals 27 are inserted through the terminal receiving clearances 32 of the terminals 3 and through the gaps 8 between the contact points 9A and 9B while the contacts shift away from each other to accommodate the associated extensions 28 and 29. Shifting results in resilient deformation of the contact beams 7A and 7B stressing to cause reacting resilient force. At the same time, movement of the contact points 9A and 9B also causes deformation of the first and second connecting pieces 10A, 10B and 12 with accumulating resilient returning force. The resilient returning force of the connecting pieces 10A, 10B and 12 cooperates with the reacting resilient force of the contact beams 7A and 7B for biasing the contacts 9A and 9B toward the respective mating edge of the extensions 28 and 29 of the pin type terminals 27 and thereby establish firm engagement for steady electric connection therebetween. The tip ends of the extensions 28 and 29 pass through the contact points 9A and 9B of the terminal 3 and extend through the housings 17 of the electric connectors 21 through the terminal receiving openings 20.

Figure 15:
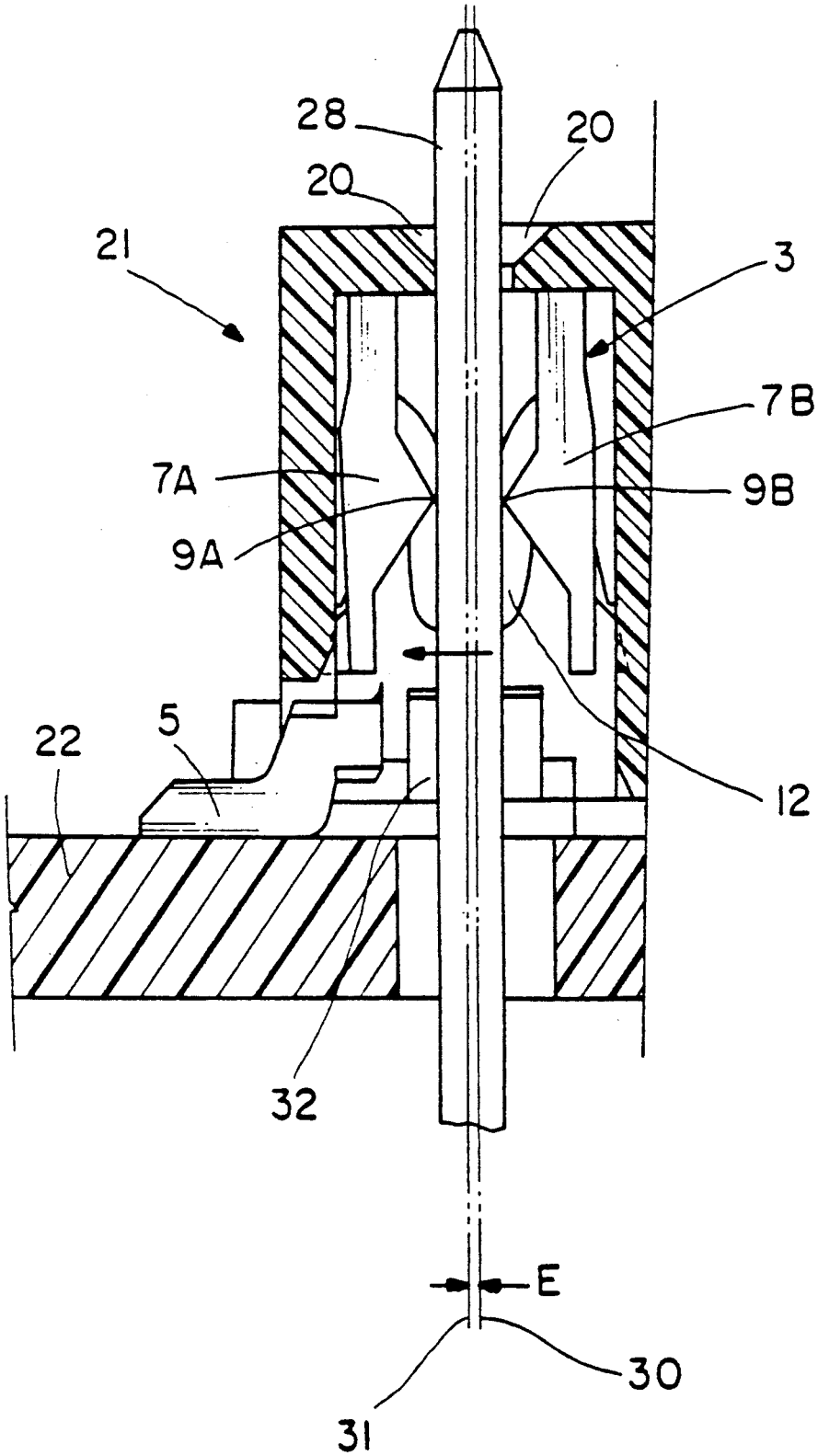
FIG. 15 is an enlarged section showing contacting action of respective contacts of a pair of contact beams of the preferred embodiment of the U-shaped terminal and the pin type terminal.

FIG. 15 shows an enlarged section of the electric connector 21 with the extension 28 inserted therethrough/ When the extension 28 of the pin type terminal 27 is inserted into the terminal 3 in the proper centered position (i.e. straight along the center line 30 between the contact beams 7A and 7B), the contact points 9A and 9B will contact the mating edge of the extension 28 with equal contact force to establish a uniform electrical connection. On the other hand, when the extension 28 is inserted along line 31 parallel to but offset a distance from the line 30 which is equal distance from contact points 9A and 9B in FIG. 15, the contact point 9A is depressed toward the left in FIG. 15 for accommodating the extension 28 while causing resilient deformation of the contact beam 7A. Such action of the contact point 9A exerts a force on the second connecting piece 12 via the first connecting piece 10A. This force is then transmitted to the contact beam 7B carrying the contact point 9B via the first connecting piece 10B to bias the contact beam 7B toward the left in FIG. 15. As a result, the contact point 9B which is carried by the contact beam 7B comes into contact with the mating edge of the extension 28. Since the second connecting piece 12 transmits the resilient force between the contact beams 7A and 7B, the resilient contact forces to be exerted on the contact points 9A and 9B are substantially unified to permit the contacts to be depressed onto the extension 28 with substantially equal resilient force. When the extension 28 is inserted in an angle relative to the center line 30 either at the right position or the offset position, a substantially similar effect of force transmission is performed by the connecting piece 12 for assuring steady contact between the contact points 9A and 9B with the extension 28.

Since the return force to return the contact points 9A and 9B with the contact beams 7A and 7B can be provided principally by the second connecting piece 12, the contact beams 7A and 7B can be formed to be flexible enough to accommodate any magnitude of offset in insertion of the male terminal. Therefore, permanent deformation of the contact beams 7A and 7B can be successfully eliminated.

As set forth above, the electric connector employing the electric connector female terminal according to the present invention, assures good electric contact irrespective of the offset or angle of insertion of the male terminal, while substantially avoiding the possibility of causing permanent deformation of the contact beams which may result in permanent contact failure. Furthermore, the connecting piece employed in the electric connector terminal according to the present invention does not interfere with the insertion and removal of the male terminal. Also, according to the present invention, the overall height of the terminal can be maintained substantially equal to that of the conventional terminals despite the presence of the connecting piece. In addition, since the contact points are located at a substantially intermediate position on the beams the lever formed by the contact beam and the first connecting piece has sufficient contact length to assure a consistent force and thereby a consistently good electrical connection.

While the invention has been described with respect to a preferred embodiment, it is apparent that various changes can be made without departing from the scope of the invention as defined by the appended claims.

We claim:

1. A terminal stamped from a sheet of metal adapted to connect a male pin with at least two opposed flat surfaces to a printed circuit board comprising:

a base having printed circuit board mounting means;

a pair of spaced apart elongated cantilevered beams integrally formed with and extending from said base;

each beam having at least one pin contacting a portion formed in an edge thereof pointing toward one another in a direction parallel to the sheet of metal;

said pair of beams bent to form three sections where each section being in a different plane and each plane being parallel to each other;

a first said section extending from said base in a first plane, a second section extending from said first section in a second plane spaced from said first plane and having said pin contacting portions, said second section defining the longitudinal axis of the terminal; and a third said section extending from said second section in a third plane spaced between said first and second planes, said third section including a resilient beam support member extending between and mechanically interconnecting the forward, free ends of said pair of beams;

whereby the pin contacting portions of said pair of beams in said second section are positioned to slidably receive and electrically engage said flat surfaces of said male pin terminal which is inserted in either direction along the longitudinal axis of the terminal.

* * * * *